US008630557B2

(12) United States Patent
Hara

(10) Patent No.: US 8,630,557 B2
(45) Date of Patent: Jan. 14, 2014

(54) MEDIUM DETECTION DEVICE AND IMAGE FORMATION APPARATUS

(75) Inventor: Shinjiro Hara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 148 days.

(21) Appl. No.: 13/303,256

(22) Filed: Nov. 23, 2011

(65) Prior Publication Data

US 2012/0134694 A1 May 31, 2012

(30) Foreign Application Priority Data

Nov. 25, 2010 (JP) ..... 2010-262854

(51) Int. Cl.
*G03G 15/20* (2006.01)

(52) U.S. Cl.
USPC ..... 399/68

(58) Field of Classification Search
USPC ..... 399/66, 67, 68
See application file for complete search history.

(56) References Cited

U.S. PATENT DOCUMENTS 6,101,365 A * 8/2000 Nishikawa ..... 399/384

FOREIGN PATENT DOCUMENTS

| | | |
|---|---|---|
| JP | 2006-092790 A | 4/2006 |
| JP | 2008-158076 A | 7/2008 |
| JP | 2009-091149 A | 4/2009 |

* cited by examiner

*Primary Examiner* — Walter L Lindsay, Jr.
*Assistant Examiner* — Barnabas Fekete
(74) *Attorney, Agent, or Firm* — Marvin A. Motsenbocker; Mots Law, PLLC

(57) ABSTRACT

An aspect is a medium detection device to detect a slack of a medium to be introduced into a fixation device in an image formation apparatus. The fixation device is detachable from a part of the image formation apparatus other than the fixation device. The medium detection device includes a lever support provided at the fixation device, a lever supported by the lever support such that the lever moves or displaces when the lever comes in contact with slack medium, a sensor support provided at the part of the image formation apparatus other than the fixation device, and a sensor supported by the sensor support and configured to detect the movement or the displacement of the lever.

22 Claims, 12 Drawing Sheets

MEDIUM DETECTION DEVICE AND IMAGE FORMATION APPARATUS

CROSS REFERENCE TO RELATED APPLICATIONS

This application claims priority based on 35 USC 119 from prior Japanese Patent Application No. 2010-262854 filed on Nov. 25, 2010, entitled "MEDIUM DETECTION DEVICE AND IMAGE FORMATION APPARATUS", the entire contents of which are incorporated herein by reference.

BACKGROUND OF THE INVENTION

1. Field of the Invention

The present disclosure relates to a medium detection device and an image formation apparatus including the same and, specifically to a medium detection device configured to detect a slack of a medium to be printed and an image formation apparatus including the same.

2. Description of Related Art

A conventional fixation device in an electrophotographic image formation apparatus includes a rotatable heat roller to fix toner to a printing medium such as paper by sufficiently fusing the toner on the printing medium. The heat roller includes a core metal having a hollow on the inside, a rubber layer formed on the outer surface of the core metal, and a halogen lamp provided in the hollow in the core metal, such that the rubber layer comes in contact with a first side of the printing medium on which a toner image is attached. Heat generated by the halogen lamp is transferred through the core metal to the rubber layer, and heats and fuses the toner image on the printing medium via the rubber layer.

A pressure roller is provided facing the heat roller, such that the printing medium having the toner image attached thereon is conveyed between the pressure roller and the heat roller while the first surface of the printing medium is pressed by the rubber layer of the heat roller. With this, toner forming the toner image is fused by the heat from the rubber layer and then fixed to the printing medium. After that, the printing medium having the toner image fixed thereon is discharged out of the image formation apparatus.

The image formation apparatus include a toner image transfer unit provided upstream of the fixation device and configured to transfer or attach the toner image to the printing medium. A medium detection device is provided to detect a slack of the printing medium, which is caused by the difference between a first medium conveyance speed of the image transfer unit and a second medium conveyance speed of the fixation device. Based on the detection by the medium detection device, the image formation apparatus controls the second medium conveyance speed of the fixation device in order to (1) prevent a slack of the printing medium, which may cause a jam of the printing medium and may cause scraping of the printing medium causing dirt in the image, and (2) prevent the printing medium from being over-tensioned between the toner image transfer unit and the fixation device which may cause an overload on a drive motor of the toner image transfer unit or the fixation device.

Japanese Patent Application Laid-Open No. 2006-92790 (Paragraphs 0018 to 0026 and FIGS. 1 and 4) discloses a medium detection device to detect a slack of a printing medium. The medium detection device is provided in a fixation device and includes a lever to be moved by the movement of the printing medium and a sensor to detect the movement of the lever.

SUMMARY OF THE INVENTION

Since the fixation device has to be attached to and detached from a body of the image formation apparatus so as to be replaceable, a connecting structure such as a connector is needed to electrically connect the sensor in the fixation device and a wire in the body of the image formation apparatus. This arrangement complicates the structure of the fixation device.

An object of an embodiment of the invention is to simplify the structure of a fixation device.

An aspect of the invention is a medium detection device to detect a slack of a medium to be introduced into a fixation device in an image formation apparatus. The fixation device is configured to be attached to and detached from a part of the image formation apparatus other than the fixation device. The image formation apparatus includes: a lever support provided at the fixation device; a lever supported by the lever support such that the lever moves or displaces when the lever comes in contact with a slack medium; a sensor support provided at the part of the image formation apparatus other than the fixation device; and a sensor supported by the sensor support and configured to detect movement or displacement of the lever.

According to this aspect, the structure of the fixation device can be simplified.

DETAILED DESCRIPTION OF EMBODIMENTS

Figure 1:
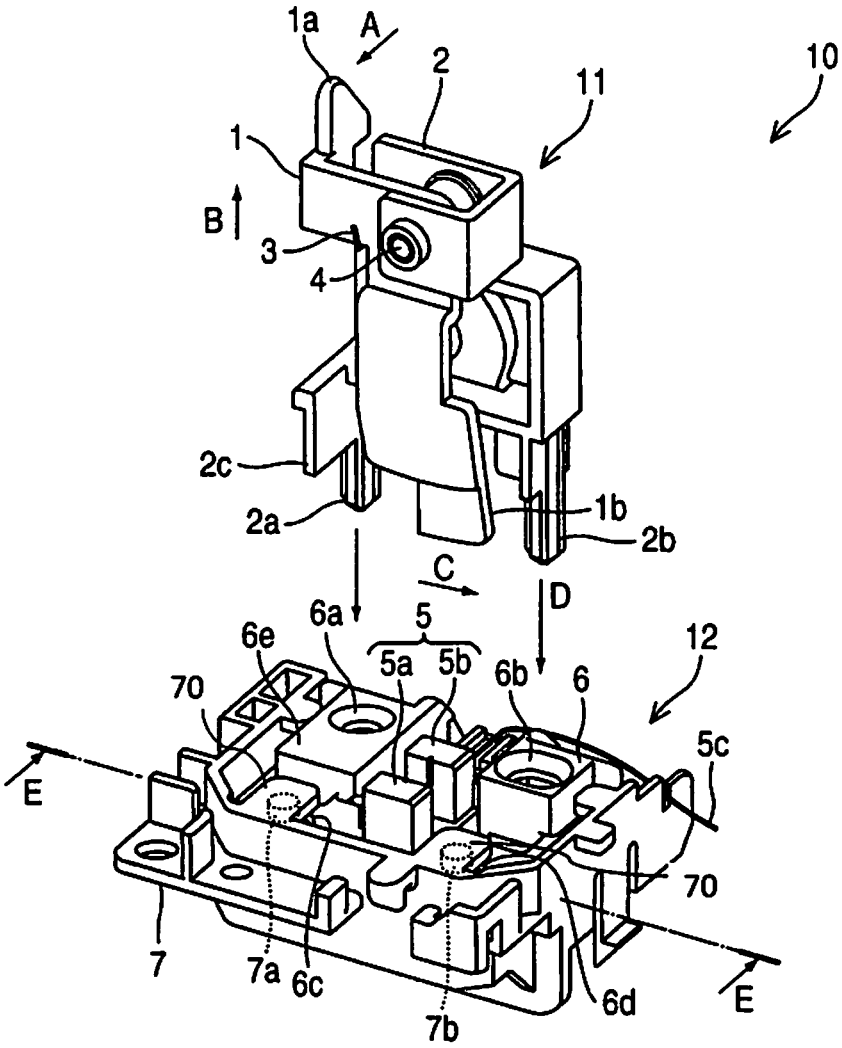
FIG. 1 is a perspective view of a medium detection device of a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

A medium detection device and an image formation apparatus according to embodiments will be described with reference to the drawings.

First Embodiment

Figure 2:
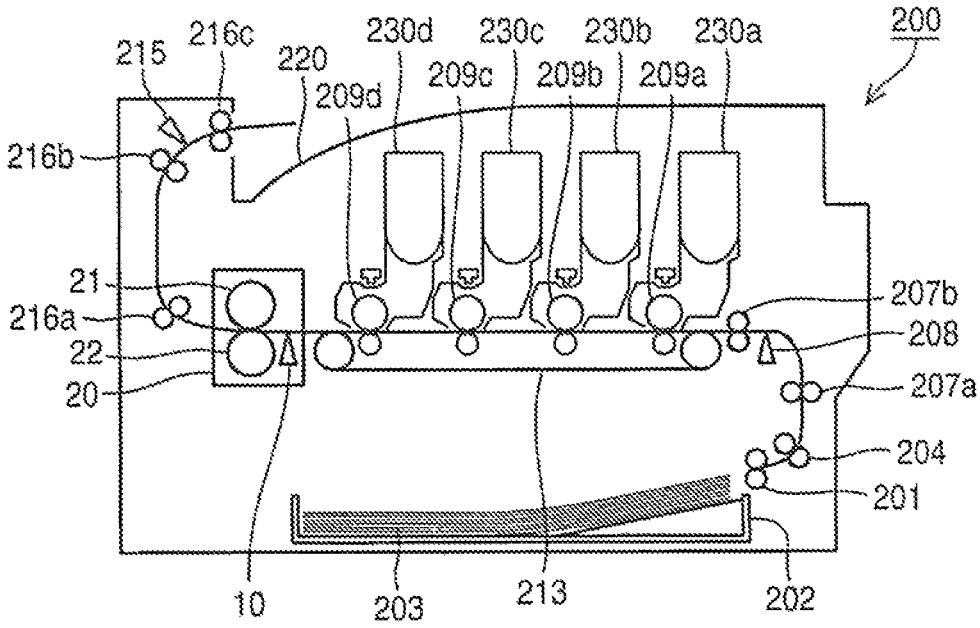
FIG. 2 a sectional view schematically illustrating the configuration of an image formation apparatus of the first embodiment.

FIG. 2 is a sectional view schematically illustrating the configuration of the image formation apparatus according to the first embodiment In FIG. 2, reference numeral 200 designates an image formation apparatus such as an electrophotographic printer. Image formation apparatus 200 includes: stacker 202 configured to accommodate media 203 or recording media being stacked thereon; feed roller 201 and conveyance rollers 207*a* and 207*b* configured to feed and convey medium 203; development devices 230 configured to form a toner image serving as a developer image (development devices 230*a*, 230*b*, 230*c*, and 230*d* configured to form color toner images of black, yellow, magenta, and cyan, respectively); belt unit 213, serving as an image transfer unit, configured to transfer and overlap the toner images formed by development devices 230 onto medium 203 while conveying medium 203; fixation device 20 configured to fix the overlapped toner image transferred onto medium 203 to medium 203 by fusing the toner image with heat; medium detection device 10 configured to detect a slack of medium 203 at an entrance of fixation device 20; discharge sensor lever 215 configured to detect a passage of medium having the toner image fixed thereon to be discharged out of the apparatus; discharge roller pairs 216*a*, 216*b*, and 216*c* configured to discharge medium 203; and discharged media stacker 220 configured to accommodate therein discharged media 203.

Fixation device 20 is configured to be attached to and detached from the body of image formation apparatus 200 (or a part of image formation apparatus 200 other than fixation device 20). Thus, a user or an operator can attach or detach fixation device 20 to or from the body of image formation apparatus 200, as opening an unillustrated upper cover provided atop of image formation apparatus 200.

Image formation apparatus 200 having the described configuration is communicatably connected to one or more external apparatuses, such as a PC (a personal computer), via communication lines or the like. Image formation apparatus 200 includes: a storage, such as a memory, to store control programs (software) or the like; and a controller such as a micro computer functioning as a calculation unit and a control unit. The controller controls an overall operation of image formation apparatus 200 using the control programs stored in the storage, including power control for supplying the power from an unillustrated power supply to drive parts such as motors, drive control of the drive parts, and print control with reference to information from sensors, in accordance with image data received from an external apparatus.

When image formation apparatus 200 receives image data from an external apparatus and stores the received image data in the storage, the controller initiates the print operation in accordance with the image data stored in the storage. First, the controller drives feed roller 201 to rotate to feed stacked media 203 stacked and held in stacker 202.

As feed roller 201 rotates to feed medium 203, the controller starts to rotate conveyance rollers 207*a* and 207*b*, photosensitive drum 209 (209*a*, 209*b*, 209*c*, 209*d*) in each development device 230, belt unit 213, discharge rollers 216*a*, 216*b*, and 216*c*, and heat roller 21 and press roller 22 in fixation device 20.

Media 203 are fed into a medium conveyance passage by the rotation of feed roller 201, and are separated one by one by separation roller 204. Medium 203 fed into the medium conveyance passage is conveyed by the rotations of conveyance roller pairs 207*a*. When the leading edge of medium 203 reaches passage sensor 208, the controller starts to form a toner image, based on the image data stored in the storage, on the surface of photosensitive drum 209 (209*a*, 209*b*, 209*c*, 209*d*) of each development device 230.

Medium 203, having been conveyed by conveyance rollers 207*a* and 207*b*, is then conveyed by and between photosensitive drums 209 and belt unit 213. While medium 203 is conveyed between photosensitive drums 209 and belt unit 213, the toner image formed on each photosensitive drum 209 is transferred onto medium 203 by means of belt unit 213. Medium 203 having the toner image transferred thereon is conveyed to fixation device 20 provided downstream from photosensitive drums 209 and belt unit 213 along the medium conveyance passage, and then the toner image is fixed to medium 203 in fixation device 20.

Medium detection device 10, which is configured to detect a slack of medium 203 being conveyed, is positioned downstream from a contact between photosensitive drum 209*d* and belt unit 213 and upstream from a contact between heat roller 21 and press roller 22 of fixation device 20. That is, medium detection device 10 is positioned at an entrance of fixation device 20.

Next, the configuration of fixation device 20 will be described with reference to FIG. 4, which is a sectional view illustrating the configuration of the fixation device and the medium detection device of the image formation apparatus according to the first embodiment.

Figure 4:
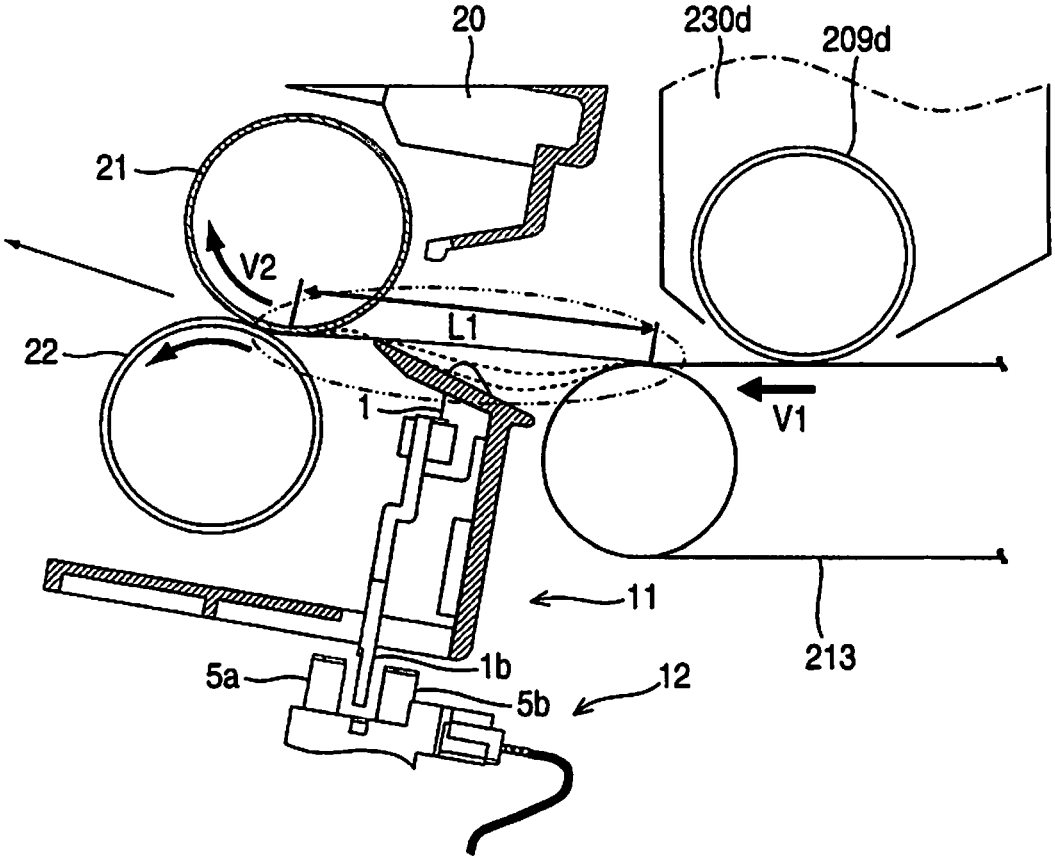
FIG. 4 is a sectional view illustrating the configuration of the fixation device and the medium detection device of the image formation apparatus according to the first embodiment.

In FIG. 4, fixation device 20 includes: heat roller 21 having therein a heater such as a halogen lamp; press roller 22 facing heat roller 21 such that circumferential surfaces of press roller 22 and heat roller 21 are in contact with each other; and lever unit 11 (see FIG. 2), which is a part of medium detection device 10. Lever unit 11 is disposed in the vicinity of the medium entrance of fixation device 20, which is the position between the contact between photosensitive drum 209*d* and belt unit 213 and the contact between heat roller 21 and press roller 22.

Heat roller 21 and press roller 22 rotate in the directions of arrows V2 to convey medium 203 that has been conveyed from belt unit 213 in a medium conveyance direction (see, an arrow in FIG. 4).

Lever 1 of lever unit 11 is disposed at a position where the tip of lever 1 is not pressed by medium 203 with no slack and the tip of lever 1 is pressed by medium 203 with a slack being conveyed between the contact between photosensitive drum 209*d* and belt unit 213 and the contact between heat roller 21 and press roller 22, in the medium conveyance passage.

Note that sensor unit 12 is disposed below fixation device 20 and is formed at or is attached to the body of image formation apparatus 200. Light blocking part 1*b* of lever 1 of lever unit 11 is disposed between light receiving part 5*b* and light emitting part 5*a* of sensor 5.

Now referring back to FIG. 2, medium 203 that was processed in fixation device 20 is conveyed by discharge roller pairs 216*a*, 216*b*, and 216*c* to be discharged onto discharged medium stacker 220 provided atop image formation apparatus 200. After all media to be printed are discharged to discharged medium stacker 220, the printing process in image formation apparatus 200 ends.

Next, the configuration of the medium detection device will be described with reference to FIG. 1, which is a perspective view of the medium detection device, FIGS. 3A and 3B, which are perspective views of the fixation device of the image formation apparatus, and FIGS. 9A and 9B, which are explanatory views of the sensor unit before being coupled with the lever unit.

FIG. 1 is the perspective view of medium detection device 10 including lever unit 11 and sensor unit 12. Arrow A in FIG. 1 indicates a medium conveyance direction in which the media are conveyed.

Figure 3A:
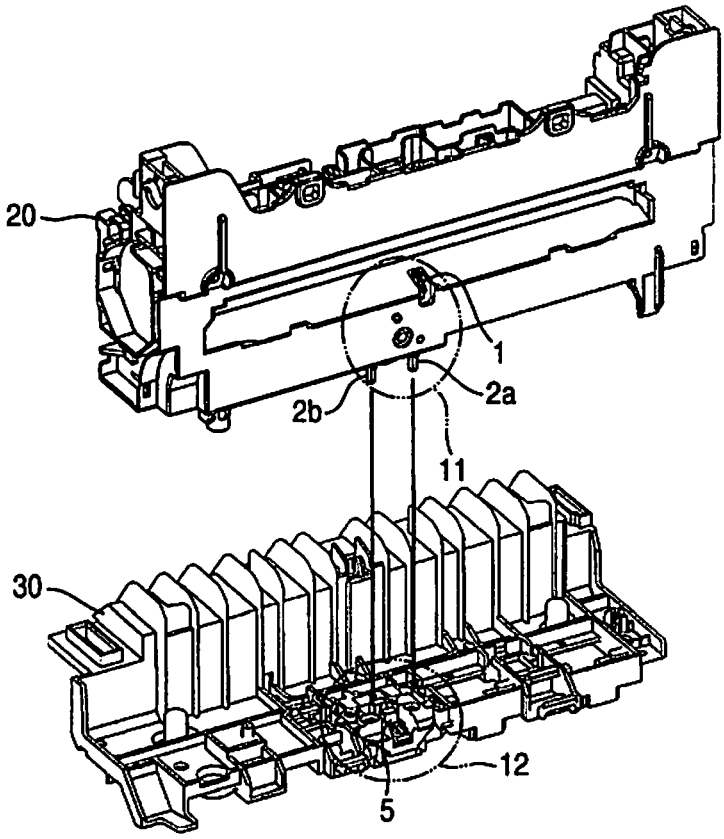
FIGS. 3A and 3B are perspective views of a fixation device of the image formation apparatus of the first embodiment.

FIG. 3A is a perspective view of fixation device 20, as seen from the upstream side in the medium conveyance direction A (see, arrow A in FIG. 1). FIG. 3A illustrates the state where fixation device 20 is detached from frame 30 of the image formation apparatus (the body of the image formation apparatus), that is, the state where lever unit 11 of medium detection device 10 is detached from sensor unit 12 of medium detection device 10, wherein medium detection device 10 includes lever unit 11 supported by fixation device 20 and sensor unit 12 supported by frame 30 of the image formation apparatus. FIG. 3B is an enlarged view of sensor unit 12. FIGS. 9A and 9B are sectional views along the E-E line in FIG. 1.

As shown in FIG. 1, lever unit 11 includes lever 1, lever base 2 serving as a lever support, spring 3, and support shaft 4. Lever 1 is disposed such that a medium with a slack comes in contact with lever 1 to displace or move lever 1. Lever base 2 supports lever 1 such that lever 1 is displaceable or movable. Spring 3, such as a torsion spring, functions as a bias member attached to lever base 2 and biasing lever 1 toward the medium conveyance passage (in the direction of arrow B in FIG. 1). Support shaft 4 is provided at lever base 2 and rotatably supports lever 1. Spring 3 coils around support shaft 4. Lever unit 11, which is a part of fixation device 20, is supported by fixation device 20 shown in FIGS. 3A and 3B.

One end of lever 1 is formed with contact portion 1*a* which a medium may come in contact with. The other end of lever 1 is formed with light blocking part 1*b* to block the optical axis of sensor unit 12. When contact portion 1*a* is pressed by the slacked medium that is being conveyed, lever 1 rotates in the direction opposite to arrow B about support shaft 4 serving as the rotational axis against the bias force of spring 3, so that light blocking part 1*b* of lever 1 moves in the direction of arrow C.

Sensor unit 12 includes optical sensor 5, sensor holder 6, sensor holder base 7, and spring 8 (see, FIGS. 9A and 9B) serving as a bias member. Sensor 5 includes light emitting part 5*a* and light receiving part 5*b*, to detect a displacement or a movement of lever 1 of lever unit 11. Sensor holder 6 or a sensor support holds sensor 5. Sensor holder base 7 holds sensor holder 6. Spring 8 (FIGS. 9A and 9B) is provided at sensor holder base 7 and biases sensor holder 6 in a direction opposite to the direction of arrow D. Note that the direction of arrow D indicates a direction of attaching lever unit 11 to sensor unit 12. As shown in FIGS. 3A and 3B, sensor unit 12 is supported by frame 30 of the image formation apparatus.

The bottom of lever base 2 of Lever unit 11 is formed with positioning projections 2*a* and 2*b* serving as first positioning parts. The upper portion of sensor unit 12 is formed with positioning holes 6*a* and 6*b* serving as second positioning parts. By inserting positioning projections 2*a* and 2*b* into positioning holes 6*a* and 6*b* in the direction of arrow D, positioning projections 2*a* and 2*b* are fitted in positioning holes 6*a* and 6*b*, so as to position lever unit 11 with respect to sensor unit 12, to unite lever unit 11 and sensor unit 12. In the state where positioning projections 2*a* and 2*b* are fitted in positioning holes 6*a* and 6*b*, rib 2*c*, serving as a first contact part or a press part formed at lever base 2, is in contact with pressed surface 6*e*, serving as a second contact part or a contact surface, formed at sensor holder 6 of sensor unit 12.

According to the medium detection device, including lever unit 11 and sensor unit 12 that are positioned to and united to each other, when contact portion 1*a* of lever 1 of lever unit 11 is in no-contact with a medium, light blocking part 1*b* of lever 1 is located between light emitting part 5*a* and light receiving part 5*b* of sensor 5 of sensor unit 12 with the bias force of spring 3 and thus blocks light emitted from light emitting part 5*a*, thereby light receiving part 5*b* does not receive the light emitted from light emitting part 5*a*.

On the other hand, when contact portion 1*a* of lever 1 of lever unit 11 comes in contact with a medium that is slacked, lever 1 rotates about support shaft 4 in the direction of arrow C, thereby light blocking part 1*b* moves away from the position between light emitting part 5*a* and light receiving part 5*b* of sensor 5 of sensor unit 12. Thus, the light emitted from light emitting part 5*a* is received by light receiving part 5*b*.

As described above, lever unit 11 is configured to be inserted into and extracted from sensor unit 12. Medium detection device 10, which is an integrated combination of lever unit 11 and sensor unit 12, detects if there is a slack of a conveyed medium by detecting the amount of light received by light receiving part 5*b* of sensor 5, and then outputs the detection result.

A terminal (s) of sensor 5 supported by sensor holder 6 is connected through signal line (s) 5*c* to the controller via an unillustrated sensor controller. The controller controls (increases and decreases) the rotational speeds of heat roller 21 and press roller 22 based on signals outputted from sensor 5, thereby controlling the amount of a slack of the medium that is being conveyed.

Figure 3B:
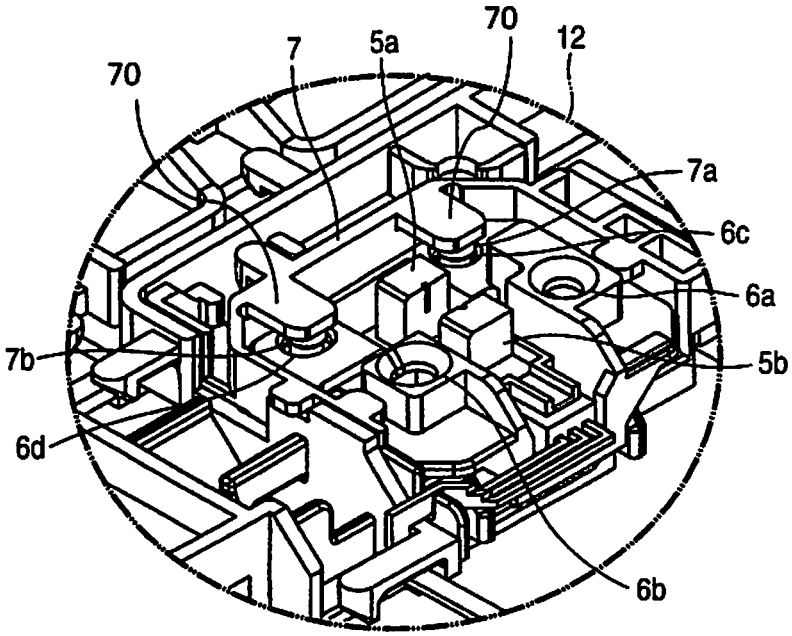
Figure 9A:
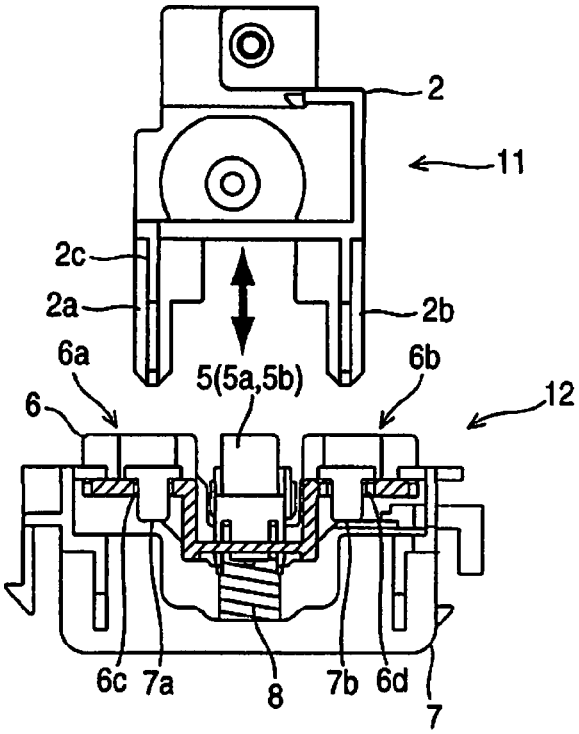
FIGS. 9A and 9B are explanatory views of a sensor unit just before being coupled with a lever unit according to the first embodiment.
Figure 9B:
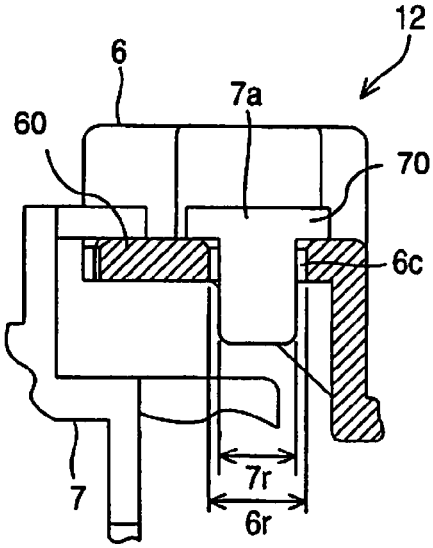

As shown in FIGS. 3B, 9A, and 9B, sensor holder 6 of sensor unit 12 is formed with guide holes 6*c* and 6*d*. Sensor holder base 7 is formed with guide pins 7*a* and 7*b* whose outer diameters are smaller than the inner diameters of guide holes 6*c* and 6*d*, respectively. Guide pins 7*a* and 7*b*, serving as first guide parts, are inserted in guide holes 6*c* and 6*d*, serving as second guide parts, with a predetermined clearance, so that guide pins 7*a* and 7*b* are held in guide holes 6*c* and 6*d* with a certain degree of freedom in a direction (a plane) orthogonal to a direction of inserting guide pins 7*a* and 7*b* into guide holes 6*c* and 6*d* (the horizontal direction in the Figure).

This engagement between guide pins 7*a* and 7*b* of sensor holder base 7 and guide holes 6*c* and 6*d* of sensor holder 6 allows sensor holder 6 to move with respect to sensor holder base 7 in the axial direction of guide pins 7*a* and 7*b* against a bias force of spring 8, serving as a bias member, provided between sensor holder 6 and sensor holder base 7.

Flange 70 or a stopper is formed at the upper end of each guide pin 7*a* and 7*b*. As shown in FIGS. 9A and 9B, the lower surface of flange 70 is in contact with the upper surface of main body 60 of sensor holder 6 with the bias force of spring 8, thereby preventing guide pins 7*a* and 7*b* from coming off guide holes 6*c* and 6*d*, that is, preventing sensor holder 6 from coming off sensor holder base 7.

Note that spring 8 biases sensor holder 6 with respect to sensor holder base 7 in the direction (the upward direction in FIG. 9A) opposite to the direction of attaching of lever unit 11 to sensor unit 12.

Operations of the above described configuration will be described.

Figure 5:
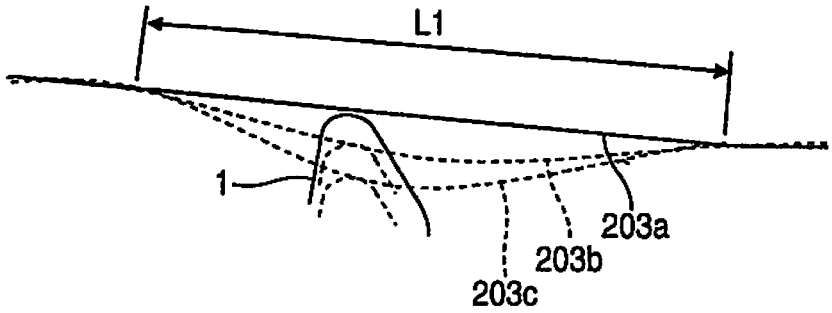
FIG. 5 is a sectional view illustrating the relationship between the medium detection device and states of a medium according to the first embodiment.

FIG. 5 is a sectional view illustrating the relationship between the medium detection device and states of the medium according to the first embodiment. Note that FIG. 5 is an enlarged view of the vicinity of lever 1 of the medium detection device in FIG. 4. FIGS. 6A to 8B are explanatory views illustrating the operations of the medium detection device, for explaining the relationship between the degree of slack of medium 203 and the state of lever 1.

FIG. 5 illustrates medium 203*a*, 203*b*, and 203*c*, which are variations of slack of medium 203 at the position (shown in FIG. 4) between the contact between photosensitive drum 209*d* and belt unit 213 and the contact between heat roller 21 and press roller 22. Medium 203*a* indicates medium 203 being stretched with no slack, medium 203*b* indicates medium 203 having a small slack, and medium 203*c* indicates medium 203 having a large slack.

Stretched medium 203*a* with no slack does not push contact portion 1*a* formed at the tip of lever 1. Medium 203*b* with the small slack pushes contact portion 1*a* slightly so that contact portion 1*a* formed at the tip of lever 1 is moved by a small distance. Medium 203*c* with the large slack pushes contact portion 1*a* more strongly so that contact portion 1*a* formed at the tip of lever 1 is moved by a large distance.

Figure 6A:
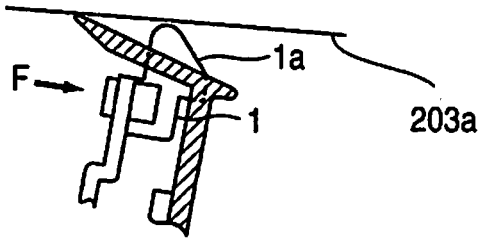
FIGS. 6A and 6B are views for explaining the operation of the medium detection device according to the first embodiment.
Figure 6B:
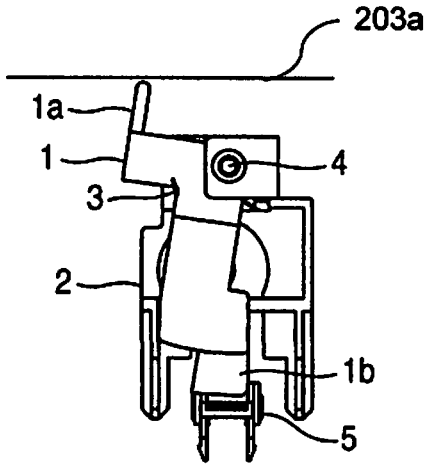
Figure 7A:
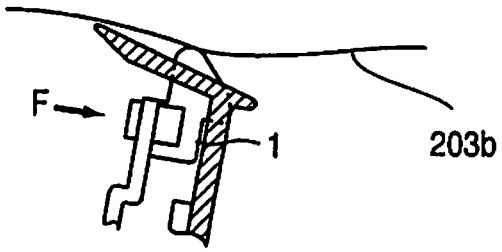
FIGS. 7A and 7B are views for explaining the operation of the medium detection device according to the first embodiment.
Figure 7B:
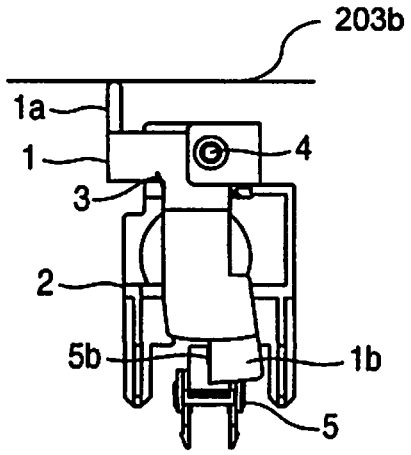
Figure 8A:
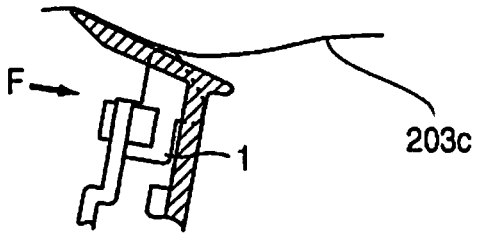
FIGS. 8A and 8B are views for explaining the operation of the medium detection device according to the first embodiment.
Figure 8B:
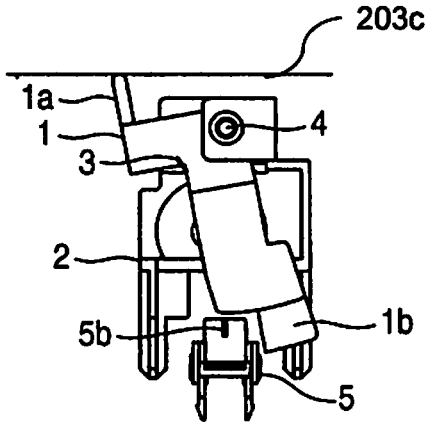

FIGS. 6A and 6B illustrate a state where contact portion 1*a* provided at the tip of lever 1 is not pushed by medium 203*a*, so that light blocking part 1*b* of lever 1 blocks the light emitted from light emitting part 5*a* of sensor 5. FIGS. 7A and 7B illustrate the state where contact portion 1*a* provided at the tip of lever 1 is slightly pushed by medium 203*b*, so that light blocking part 1*b* of lever 1 is at a boundary between an area where light blocking part 1*b* blocks and an area where light blocking part 1*b* does not block the light emitted from light emitting part 5*a* of sensor 5. FIGS. 8A and 88 illustrate the state where contact portion 1*a* provided at the tip of lever 1 is strongly pushed by medium 203*a*, so that light blocking part 1*b* of lever 1 does not block the light emitted from light emitting part 5*a* of sensor 5. Note that FIGS. 6A, 7A, and 8A illustrate the relationship between lever 1 and medium 203, whereas FIGS. 6B, 7B, and 8B illustrate the medium detection device as seen along the direction of arrow F in FIGS. 6A, 7A, and 8A.

Referring back to FIG. 4, at an initial state at the start of the print operation, medium conveyance speed V1 by belt unit 213 is set greater than medium conveyance speed V2 by heat roller 21 and press roller 22. That is, the expression of "V1>V2" is satisfied in the initial state.

When a time T has elapsed while a downstream portion of medium 203 is conveyed by belt unit 213 at medium conveyance speed V1 and an upstream portion of medium 203 is conveyed by the pair of heat roller 21 and press roller 22 at medium conveyance speed V2, an extra length of "(V1−V2)× T" occurs with respect to distance L1 between belt unit 213 and the contact between heat roller 21 and press roller 22, thereby medium 203 gets a slack, accordingly.

Such a slack medium 203 presses the tip of lever 1 of medium detection device 10 at the medium entrance of fixation device 20 and thus rotates lever 1 as shown in FIGS. 7A and 7B and FIGS. 8A and 8C. With the rotation of lever 1, light blocking part 1*b* of lever 1 moves away from the position between light emitting part 5*a* and light receiving part 5*b* of sensor 5 attached to frame 30 (see, FIG. 3) of image formation apparatus 200 as shown in FIGS. 8A and 8B. Light receiving part 5*b* of sensor 5 thus receives the light emitted from light emitting part 5*a* of sensor 5, thereby the controller detects a slack of medium 203 based on an output signal from sensor 5.

In detecting the slack of medium 203, the controller escalates medium conveyance speed V2 by heat roller 21 and press roller 22 by rising the rotation speed of the motor in a step-by-step manner.

By escalating medium conveyance speed V2 by heat roller 21 and press roller 22, after a while, medium conveyance speed V2 becomes greater than medium conveyance speed V1 by belt unit 213 (V2>V1). With this, as shown in FIGS. 7A and 7B, the degree of the slack of medium 203 decreases, thereby light blocking part 1*b* of lever 1 rotates toward the position between light emitting part 5*a* and light receiving part 5*b* of sensor 5. When medium 203*a* comes into a no press-contact with lever 1 as shown in FIGS. 6A and 6B, light blocking part 1*b* of lever 1 gets back to the position between light emitting part 5*a* and light receiving part 5*b* of sensor 5 and blocks the light from light emitting part 5*a* of sensor 5. Thus, the controller detects, based on the output signal from sensor 5, there is no slack of medium 203.

In detecting there is no slack of medium 203, the controller lowers medium conveyance speed V2 by heat roller 21 and press roller 22 by decreasing the rotation speed of the motor in a step-by-step manner.

By lowering the medium conveyance speed V2 of heat roller 21 and press roller 22 in a step-by-step manner, after a while, medium conveyance speed V2 becomes less than medium conveyance speed V1 by belt unit 213 (V2<V1). Accordingly, the degree of slack of medium 203 increases, thereby light blocking part 1*b* of lever 1 starts to move away from the position between light emitting part 5*a* and light receiving part 5*b* of sensor 5 as shown in FIGS. 7A and 7B. After that, as medium 203*c* pushes lever 1 as shown in FIGS. 8A and 8B, light blocking part 1*b* of lever 1 moves away from the position between light emitting part 5*a* and light receiving part 5*b* of sensor 5. Light receiving part 5*b* of sensor 5 thus receives the light from light emitting part 5*a* of sensor 5, thereby the controller determines, based on the output signal from sensor 5, there is a slack of medium 203.

The controller repeats the above described operation until the printing process ends.

Next, operations of medium detection device 10 associated with attachment and detachment of fixation device 20 will be described with reference to FIGS. 1, 3A, 3B, 9A, 9B, 10A, and 10B.

As shown in FIG. 1 and FIGS. 3A and 3B, medium detection device 10 can be divided into lever unit 11 mounted in fixation device 20 and sensor unit 12 mounted in frame 30 of image formation apparatus 200. Upon attachment and detachment of fixation device 20 to and from frame 30 of image formation apparatus 200, lever unit 11 is coupled with, and separated from, sensor unit 12, respectively.

Figure 10A:
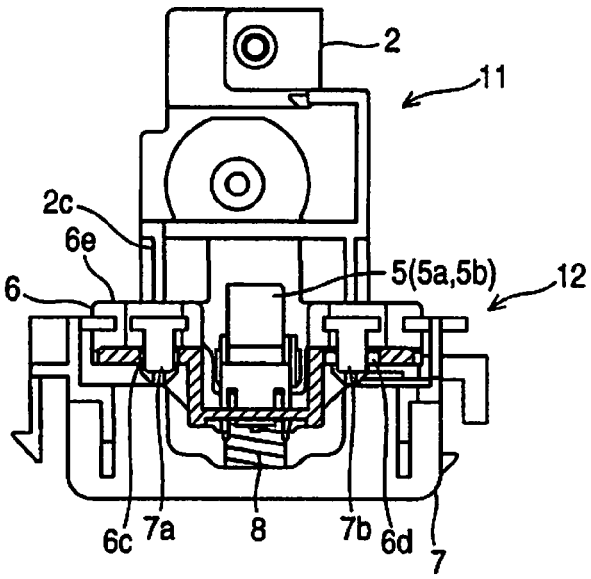
FIGS. 10A and 10B are explanatory views of the sensor unit after being coupled with the lever unit according to the first embodiment.
Figure 10B:
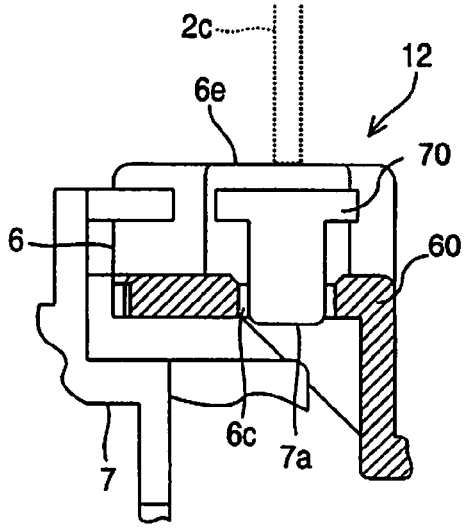

FIGS. 9A and 9B and FIGS. 10A and 10B are views for explaining coupling of the sensor unit and the lever unit according to the first embodiment. FIG. 9A is a view of the sensor unit just before being coupled with the lever unit. FIG. 10A is a view of the sensor unit in a state where the sensor unit is coupled with the lever unit. FIGS. 9B and 10B are partial enlarged views of FIGS. 9A and 10A, respectively, illustrating the vicinity of the guide pin of the sensor unit.

For precisely adjusting the positional relationship between sensor 5 of sensor unit 12 attached to frame 30 and lever 1 of lever unit 11 attached to fixation device 20 upon attaching fixation device 20 to frame 30 of image formation apparatus 200 as shown FIG. 1 and FIGS. 3A and 3B, sensor holder 6 of sensor unit 12 is always biased by spring 8 serving as a bias member in the direction (the upward direction in the Figures) opposite to the direction of inserting lever unit 11, as shown in FIGS. 9A and 9B, while guide holes 6*c* and 6*d* of sensor holder 6 and guide pins 7*a* and 7*b* of sensor holder base 7 are loosely fitted to each other with a certain degree of freedom.

For example, as shown in FIG. 9B, sensor holder 6 has an allowance (a clearance) of "6*r*-7*r*" in the horizontal direction with respect to sensor holder base 7, where "6*r*" represents the inner diameter of guide holes 6*c* and 6*d* of sensor holder 6 and "7*r*" represents the outer diameter of guide pins 7*a* and 7*b* of sensor holder base 7.

Along with the attachment operation of fixation device 20 to frame 30 of image formation apparatus 200 as shown in FIGS. 9A and 10A, positioning projections 2*a* and 2*b* of lever base 2 of lever unit 11 are inserted into positioning holes 6*a* and 6*b* of sensor holder 6 of sensor unit 12 as shown in FIG. 1.

This engagement between positioning projections 2*a* and 2*b* and positioning holes 6*a* and 6*b* makes sensor 5 move into a proper position with respect to lever 1 in the direction (the horizontal direction in the Figures) perpendicular to the direction of inserting lever unit 11, by making the sensor holder 6 move with respect to sensor holder base 7 with benefit of the allowance of "6*r*-7*r*" in the horizontal direction.

Also, along with the attachment operation of fixation device 20 to frame 30 of image formation apparatus 200 as shown in FIGS. 9A and 10A, rib 2*c* of lever base 2 comes in contact with pressed surface 6*e* of sensor holder 6 and pushes down sensor holder 6 with respect to sensor holder base 7 against spring 8 whose bias force is applied to the upward direction (the direction opposite to the direction of attaching of lever unit 11 to sensor unit 12). In the state where fixation device 20 is attached to frame 30 of image formation apparatus 200, that is, in the state where lever unit 11 is coupled to sensor unit 12, as shown in FIGS. 10A and 10B, rib 2*c* of lever base 2 is in contact with pressed surface 6*e* of sensor holder 6, thereby positioning light blocking part 1*b* (not shown in FIGS. 10A and 10B) of lever 1 in place with respect to light emitting part 5*a* and light receiving part 5*b* of sensor 5 in the direction (the vertical direction in Figures) of inserting lever unit 11.

In short, along with the attachment operation of fixation device 20 to frame 30 of image formation apparatus 200, lever unit 11 is positioned in place with respect to sensor unit 12 both in the direction of inserting lever unit 11 (the vertical direction) and in the direction perpendicular to the direction of inserting lever unit 11 (the horizontal direction), such that light blocking part 1*b* of lever 1 of lever unit 11 is positioned between light emitting part 5*a* and light receiving part 5*b* of sensor 5 of sensor unit 12, so as to detect a slack of the medium.

According to the first embodiment, as shown in FIGS. 3A and 3B, medium detection device 10 includes lever unit 11 and sensor unit 12 which are separable from each other. Lever unit 11 is integrated in fixation device 20 which is detachable from frame 30 of image formation apparatus. Sensor unit 12 is integrated in frame 30 of the image formation apparatus. This configuration can make the optical sensor 5 of medium detection device 10 less likely to be affected by the heat source (for example, heat roller 21) of the fixation device or can enlarge the distance between the optical sensor 5 and the heat source (for example, heat roller 21).

According to the first embodiment, as shown in FIG. 4, sensor unit 12 with optical sensor 5 is disposed below fixation device 20. This configuration shortens the distance between belt unit 213 serving as the image transfer unit and fixation device 20. Consequently, the image formation apparatus can be downsized.

According to the first embodiment, optical sensor 5 is provided below the heat source of fixation device 20 (heat roller 21). This configuration decreases the affection from the heat source of fixation device 20 (heat roller 21) to sensor 5.

According to the first embodiment, sensor 5 of sensor unit 12 and the wire(s) connected to sensor 5 are attached to frame 30 of the image formation apparatus (the body of the image formation apparatus). Therefore, the wire(s) for the medium detection device do not need to be located in fixation device 20.

Again, in the first embodiment, medium detection device 10 includes lever unit 11 and sensor unit 12 which are separable from each other, and lever unit 11 is provided at fixation device 20 which is detachable from frame 30 of image formation apparatus and sensor unit 12 is provided at frame 30 of the image formation apparatus. This configuration makes the optical sensor 5 of medium detection device 10 less likely to be affected by the heat source (for example, heat roller 21) of the fixation device or enlarges the distance between the optical sensor 5 and the heat source.

Also, in the first embodiment, the sensor 5 of sensor unit 12 and the wire(s) connected to the sensor is attached to the body of the image formation apparatus. The wire(s) for the medium detection device does not need to be provided in the fixation device.

The medium detection device having the above described configuration can downsize the image formation apparatus while being capable of properly detecting a slack of the medium between the belt unit and the fixation device.

Second Embodiment

The configuration of the second embodiment is different from the first embodiment in that a sensor unit of the second embodiment is different from that of the first embodiment. The configuration of the sensor unit according to the second embodiment will be described with reference to FIGS. 11A and 11B, which illustrate the state before the lever unit and the sensor unit are coupled to each other.

Figure 11A:
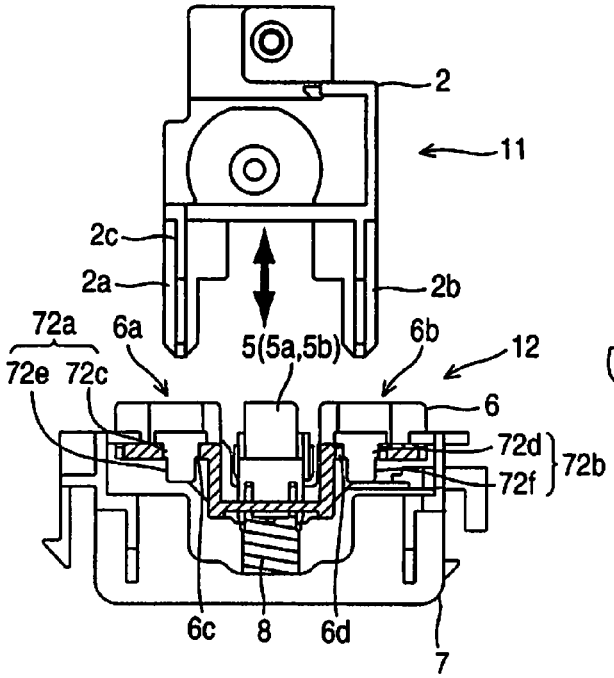
FIGS. 11A and 11B are explanatory views of a sensor unit before being coupled with a lever unit according to a second embodiment.
Figure 11B:
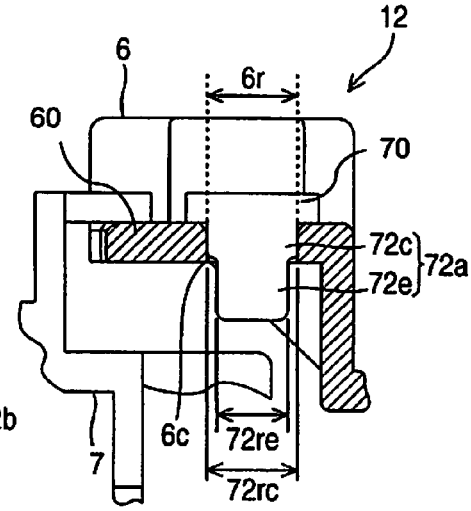

Note that FIG. 11A is a view illustrating the sensor unit upon receiving the lever unit and FIG. 11B is an enlarged view of the vicinity of the guide pin of the sensor unit shown in FIG. 11A. The configurations that are the same as in the first embodiment are denoted by the same reference numerals, and the descriptions thereof are omitted in the second embodiment for simplification.

Referring to FIGS. 11A and 11B, sensor unit 12 includes sensor 5, sensor holder 6, sensor holder base 7, and spring 8 and is provided at frame 30 (see FIGS. 3A and 3B) of the image formation apparatus. Sensor 5 is attached to sensor holder 6 or a sensor support. Sensor holder 6 and spring 8 serving as a bias member are attached to sensor holder base 7.

Sensor holder base 7 is formed with guide pins 72*a* and 72*b*, serving as first guide parts. Guide pins 72*a* and 72*b* are respectively inserted in guide holes 6*c* and 6*d* of sensor holder 6. Guide pins 72*a* and 72*b* extend from flanges 70 of sensor holder base 7. Guide pins 72*a* and 72*b* include base portions 72*c* and 72*d* (or first portions) and end portions 72*e* and 72*f* (or second portions) whose diameters are smaller than base portion 72*c* and 72*d*, respectively.

Guide pins 72*a* and 72*b* of sensor holder base 7 are inserted in guide holes 6*c* and 6*d* of sensor holder 6, while spring 8 biases sensor holder 6 with respect to sensor holder base 7. With this configuration, sensor holder 6 is maintained in place with respect to sensor holder base 7 both in the horizontal direction and in the vertical direction.

Guide hole 6*c* of sensor holder 6 and guide pin 72*a* of sensor holder base 7 will be described more with reference to FIG. 11B.

In FIG. 11B, reference numeral "6*r*" represents the inner diameter of guide hole 6*c* of sensor holder 6, "72*rc*" represents the outer diameter of base portion 72*c* of guide pin 72*a* of sensor holder base 7, and "72*re*" represents the outer diameter of end portion 72*e* of guide pin 72*a* of sensor holder base 7. Base portion 72*c* of guide pin 72*a* fits in guide hole 6*c* and thus outer diameter 72*rc* of base portion 72*c* of guide pin 72*a* is approximately the same as the inner diameter 6*r* of guide hole 6*c*. On the other hand, outer diameter 72*re* of end portion 72*e* of guide pin 72*a* is smaller than outer diameter 72*rc* of base portion 72*c* of guide pin 72*a* (inner diameter 6*r* of guide hole 6*c*).

Thus, when base portion 72*c* of guide pin 72*a* of sensor holder base 7 is fitted in guide hole 6*c* of sensor holder 6, there is no or little clearance between base portion 72*c* and guide hole 6*c*. When end portion 72*e* of guide pin 72*a* of sensor holder base 7 is located in guide hole 6*c* of sensor holder 6, there is a clearance of "6*r*-72*re*" between end portion 72*e* and guide hole 6*c*.

The height (the axial length) of base portion 72*c* of guide pin 72*a* is approximately the same as the height (the axial length) of guide hole 6*c*. Note that guide hole 6*d* of sensor holder 6 and guide pin 72*b* of sensor holder base 7 have the same configuration as guide hole 6*c* and guide pin 72*a*, respectively.

Next, operation of the above configuration according to the second embodiment will be described.

Note that operation of the image formation apparatus and operation of the medium detection device attached to the image formation apparatus in the second embodiment are the same as those of the first embodiment and thus description of those are omitted in the second embodiment. Thus, operation of the medium detection device upon attachment and detachment of the fixation device will be described with reference to FIGS. 11A and 11B and FIGS. 12A and 12B.

As shown in FIG. 1 and FIGS. 3A and 3B, in the same manner as in the first embodiment, medium detection device 10 is able to be divided into lever unit 11 integrated in fixation device 20 and sensor unit 12 integrated in frame 30 of image formation apparatus 200. Thus lever unit 11 is coupled to and separated from sensor unit 12 along with the attachment and detachment of fixation device 20 to and from image formation apparatus 200.

Figure 12A:
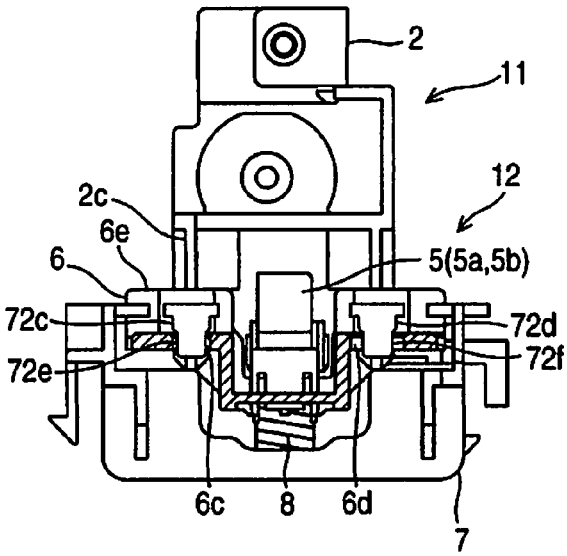
FIGS. 12A and 12B are explanatory views of the sensor unit before being coupled with the lever unit according to the second embodiment.
Figure 12B:
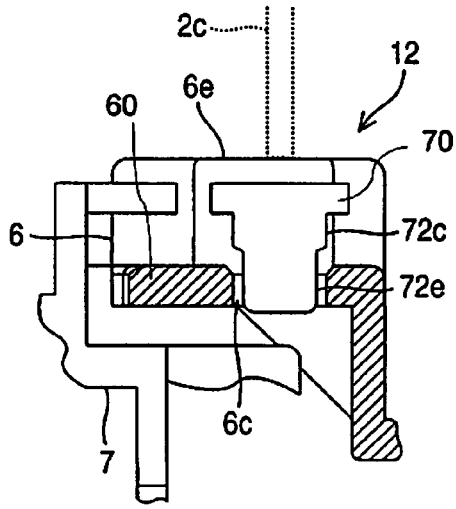

FIGS. 11A, 11B, 12A, and 12B are views for explaining coupling of the sensor unit to the lever unit according to the second embodiment. FIG. 11A illustrates the state before the sensor unit is coupled to the lever unit, whereas FIG. 12A illustrates the state where the sensor unit is coupled to the lever unit. FIGS. 11B and 12B are enlarged view of a part of FIGS. 11A and 12A, respectively, illustrating the vicinity of the guide pin of the sensor unit.

Before attaching fixation device 20 to frame 30 of image formation apparatus 200 as shown in FIG. 1 and FIGS. 3A and 3B, sensor unit 12 is able to receive lever unit 11 such that base portions 72*c* and 72*d* of guide pins 72*a* and 72*b* of sensor holder base 7 fit into guide holes 6*c* and 6*d* of sensor holder 6 as shown in FIGS. 11A and 11B. In this state, for accurately positioning lever 1 of lever unit 11 of fixation device 20 with respect to sensor 5 of sensor unit 12 of frame 30, sensor holder 6 of sensor unit 12 is movable with respect to sensor holder base 7, in the longitudinal direction of guide pins 72*a* and 72*b* (the vertical direction in the figures) with the bias force of spring 8 as shown in FIG. 11. The bias force of spring 8 is directed against the direction (the downward direction in the figures) of attaching lever unit 11 to sensor unit 12.

In this state, base portions 72*c* and 72*d* of guide pins 72*a* and 72*b* of sensor holder base 7 fit into guide holes 6*c* and 6*d* of sensor holder 6 with substantially no clearance therebetween. Therefore, sensor holder 6 is positioned in place with respect to sensor holder base 7, and thus positioning holes 6*a* and 6*b* are positioned in place. Accordingly, positioning holes 6*a* and 6*b* of sensor holder 6, which are always positioned in the same places, will receive therein positioning projections 2*a* and 2*b* of lever base 2 of lever unit 11 as shown in FIG. 1. This prevents the tips of positioning projections 2*a* and 2*b* from being out of alignment with positioning holes 6*a* and 6*b* and from colliding against pressed surface 6*e* of sensor holder 6, upon coupling of lever unit 11 to sensor unit 12 as shown in FIG. 1.

Along with the attachment operation of fixation device 20 to frame 30 of image formation apparatus 200, rib 2*c* of lever base 2 of lever unit 11 comes in contact with, and pushes, pressed surface 6*e* of sensor holder 6, thereby pushing sensor holder 6 with respect to sensor holder base 7 in the direction (the downward direction) of attaching lever unit 11 to sensor unit 12. With this, guide holes 6*c* and 6*d* of sensor holder 6 move from the initial position (shown in FIGS. 11A and 11B) where base portions 72*c* and 72*d* of guide pins 72*a* and 72*b* are fitted in guide holes 6*c* and 6*d* to a position (show in FIGS. 12A and 12B) where end portions 72*e* and 72*f* of guide pins 72*a* and 72*b* loosely fit in guide holes 6*c* and 6*d*. Thus, sensor holder 6 becomes movable with respect to sensor holder base 7 in the horizontal direction, since end portions 72*e* and 72*f* of guide pins 72*a* and 72*b* of sensor holder base 7 loosely fit in guide holes 6*c* and 6*d* of sensor holder 6 with a clearance of "6*r*-72*re*" therebetween.

Positioning projections 2*a* and 2*b* of lever base 2 of lever unit 11 are inserted into positioning holes 6*a* and 6*b* of sensor holder 6 of sensor unit 12 when sensor holder 6 becomes movable in the horizontal direction (either immediately before or immediately after). This positions sensor holder 6 with respect to sensor holder base 7 in the direction (the horizontal direction in the figures) orthogonal to the direction of attaching lever unit 11 to sensor unit 12. That is, this positions sensor 5 with respect to lever 1 in the horizontal direction.

After that, in the state where fixation device 20 is attached to frame 30 of image formation apparatus 200 (that is, in the state where lever unit 11 is coupled to sensor unit 12) as shown in FIG. 12, pressed surface 6*e* of sensor holder 6, pressed by rib 2*c* of lever base 2 of lever unit 11, is positioned with respect to sensor holder base 7 in the vertical direction. Consequently, lever 1 is positioned with respect to sensor 5 in the direction of attaching lever unit 11 (the vertical direction in the figures). That is, light blocking part 1*b* of lever 1 is positioned with respect to light emitting part 5*a* and light receiving part 5*b* of sensor 5 in the vertical direction.

According to the second embodiment, since the outer diameter of base portions 72*c* and 72*d* of guide pins 72*a* and 72*b* of sensor holder base 7 of sensor unit 12 is designed to be substantially the same as the inner diameter of guide holes 6*c* and 6*d*, sensor holder 6's positioning holes 6*a* and 6*b*, always in position as shown in FIG. 1, can receive therein positioning projections 2*a* and 2*b* of lever unit 11. This prevents the tips of positioning projections 2*a* and 2*b* of lever unit 11 from being out of alignment with positioning holes 6*a* and 6*b* of sensor holder 6 and then colliding against pressed surface 6*e* of sensor holder 6 upon coupling of lever unit 11 to sensor unit 12.

According to the second embodiment, the outer diameter of end portions 72*e* and 72*f* of guide pins 72*a* and 72*b* of sensor holder base 7 of sensor unit 12 is designed smaller than the outer diameter of base portions 72*c* and 72*d* of guide pins 72*a* and 72*b*. With this, sensor holder 6 becomes movable with respect to sensor holder base 7 in the direction (the horizontal direction in the figures) orthogonal to the direction of attaching lever unit 11, when the fixation device is attached to the body of the image formation apparatus. After that, positioning projections 2*a* and 2*b* of lever base 2 of lever unit 11 are inserted into positioning holes 6*a* and 6*b* of sensor holder 6 of sensor unit 12. This makes sensor holder 6 move with respect to sensor holder base 7 in the direction (the vertical direction in the Figures) orthogonal to the direction of inserting lever unit 11 to sensor holder 6, so as to position sensor 5 in place with respect to lever 1 in the vertical direction.

Again, according to the second embodiment, since the outer diameter of base portions 72*c* and 72*d* of guide pins 72*a* and 72*b* of sensor holder base 7 of sensor unit 12 is designed to be substantially the same as the inner diameter of guide holes 6*c* and 6*d*, positioning holes 6*a* and 6*b* of sensor holder 6 are always in the position shown in FIG. 1 before the fixation device is attached to the body of the image formation apparatus. Thus, positioning holes 6*a* and 6*b* of sensor holder 6 receive therein positioning projections 2*a* and 2*b* of lever unit 11 properly. This prevents the tips of positioning projections 2*a* and 2*b* of lever unit 11 from colliding against pressed surface 6*e* of sensor holder 6 when coupling lever unit 11 to sensor unit 12. That is, lever unit 11 is coupled to sensor unit 12 without fault.

Note that the first and second embodiments describe the electrophotographic printer as an image formation apparatus, but the invention is not limited to this. The image formation apparatus may be an apparatus that needs to detect the state of a medium, such as a copy machine, a facsimile machine, a MFP (Multi-Function Peripheral/Printer), and the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A medium detection device to detect a slack of a medium to be introduced into a fixation device in an image formation apparatus, the fixation device being detachable from a part of the image formation apparatus, wherein the medium detection device comprises:

a lever support provided at the fixation device;

a lever supported by the lever support such that the lever is displaced when the lever comes in contact with a slack medium;

a sensor support provided at the part of the image formation apparatus other than the fixation device; and a sensor supported by the sensor support and configured to detect a displacement of the lever, wherein the lever support includes a first positioning part and a first contact part, the sensor support includes a second positioning part and a second contact part, wherein the second positioning part is engaged with the first positioning part and the second contact part is pressed by the first contact part when the fixation device is attached to the part of the image formation apparatus other than the fixation device.

2. The medium detection device of claim 1, further comprising:

a first guide part provided at the part of the image formation apparatus other than the fixation device; and a second guide part provided at the sensor support, the second guide part being configured to be engaged with the first guide part such that the sensor support is movable with respect to the part of the image formation apparatus other than the fixation device in a first direction.

3. The medium detection device of claim 2, wherein one of the first guide part and the second guide part is a guide pin, the other of the first guide part and the second guide part is a guide hole, wherein the guide hole extends in the first direction such that the sensor support is movable with respect to the part of the image formation apparatus other than the fixation device in the first direction.

4. The medium detection device of claim 3, wherein the outer diameter of the guide pin is smaller than the inner diameter of the guide hole such that the sensor support is movable with respect to the part of the image formation apparatus other than the fixation device in a second direction orthogonal to the first direction in a state before the first positioning part and the second positioning part are engaged with each other.

5. The medium detection device of claim 3, wherein the guide pin includes a first portion having a first portion outer diameter and a second portion having a second portion outer diameter wherein the second portion outer diameter is smaller than the first portion outer diameter, the guide hole comprises an inner diameter that is substantially the same as the first portion outer diameter, and the contact parts, guide pins and guide holes are configured such that upon attaching the fixation device to the part of the image formation apparatus the first contact part presses the second contact part, whereupon the sensor support moves from a fit position where the first portion of the guide pin fits in the guide hole, to a loosely fit position where the second portion of the guide pin loosely fits in the guide hole.

6. The medium detection device of claim 1, wherein one of the first positioning part and the second positioning part is a projection, and the other of the first positioning part and the second positioning part is a hole.

7. The medium detection device of claim 1, wherein the first direction parallels to a direction of coupling the first positioning part to the second positioning part upon attaching the fixation device to the part of the image formation apparatus other than the fixation device.

8. The medium detection device of claim 1, wherein the first direction parallels to a direction of pressing the first contact part against the second contact part when attaching the fixation device to the part of the image formation apparatus other than the fixation device.

9. The medium detection device of claim 8, further comprising:

a bias member configured to bias the lever support in a direction opposite to the direction of pressing the first contact part against the second contact part.

10. The medium detection device of claim 1, wherein the sensor includes a light emitting part and a light receiving part to receive light from the light emitting part, the lever is supported by the lever support such that the lever is movable between a blocking position where the lever blocks the light from the light emitting part to the light receiving part and a unblocking position where the lever does not block the light.

11. The medium detection device of claim 10, further comprising a bias member configured to bias the lever toward one of the blocking position and the unblocking position.

12. The medium detection device of claim 11, wherein the lever is moved from the one of the blocking position and the unblocking position to the other of the blocking position and the unblocking position, when the medium having a slack comes in contact with the lever.

13. The medium detection device of claim 1, wherein the lever support is integrally formed with the fixation device.

14. The medium detection device of claim 1, wherein the lever support is attached to the fixation device.

15. The medium detection device of claim 1, further comprising a base supporting the sensor support to be movable, the base being integrally formed with a frame of the image formation apparatus.

16. The medium detection device of claim 1, further comprising a base supporting the sensor support to be movable, the base being attached to a frame of the image formation apparatus other than the fixation device.

17. An image formation apparatus comprising the medium detection device according to claim 1.

18. An image formation apparatus, comprising:

a development device configured to form a developer image;

an image transfer unit configured to transfer the developer image onto a medium;

a fixation device configured to fix the developer image to the medium, the fixation device being detachable from a part of the image formation apparatus other than the fixation device; and the medium detection device according to claim 1.

19. A medium detection device to detect a medium being conveyed in a first direction which is a medium conveyance direction, wherein the medium detection device comprises:

a lever support;

a lever having a first portion and a second portion and rotatably supported by the lever support such that when the first lever portion comes in contact with the medium being conveyed in the first direction and is displaced in a second direction substantially orthogonal to the first direction, the lever rotates to convert the second direction displacement of the first lever portion into displacement of the second lever portion in a third direction substantially orthogonal to both the first direction and the second direction;

a sensor configured to detect the displacement in the third direction of the second lever portion; and a sensor support supporting the sensor.

20. An image formation apparatus comprising the medium detection device of claim 19, wherein the lever support is provided at a fixation device that is detachable from a part of the image formation apparatus, and wherein the sensor support is provided at the part of the image formation apparatus other than the fixation device.

21. The image formation apparatus of claim 20, wherein the lever support includes a positioning projection and a press part, wherein the sensor support is movably attached to the part of the image formation apparatus and includes a positioning hole and a contact surface, and wherein the positioning hole is inserted into the positioning projection and the contact surface is in contact with the press part when the fixation device is attached to the part of the image formation apparatus other than the fixation device.

22. The image formation apparatus of claim 21, further comprising:

a guide pin provided at the part of the image formation apparatus other than the fixation device, wherein the guide pin includes a base portion and an end portion having an outer diameter that is smaller than an outer diameter of the base portion; and a guide hole provided at the sensor support and having an inner diameter that is substantially the same as the outer diameter of the base portion of the guide pin, wherein the guide pin is configured to be fitted into the guide hole, and wherein, upon attaching the fixation device to the part of the image formation apparatus, the press part presses the contact surface of the sensor support, thereby moving the sensor support from a fit position where the base portion of the guide pin fits in the guide hole, to a loosely fit position where the end portion of the guide pin loosely fits in the guide hole.

* * * * *